US009387378B2

(12) United States Patent
Shimono et al.

(10) Patent No.: US 9,387,378 B2
(45) Date of Patent: Jul. 12, 2016

(54) GOLF CLUB SHAFT FOR WOOD CLUB

(71) Applicant: Mitsubishi Rayon Co., Ltd., Tokyo (JP)

(72) Inventors: Satoshi Shimono, Toyohashi (JP); Takashi Kaneko, Toyohashi (JP); Masahiro Kishi, Toyohashi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 14/403,283

(22) PCT Filed: May 28, 2013

(86) PCT No.: PCT/JP2013/064715

§ 371 (c)(1),
(2) Date: Nov. 24, 2014

(87) PCT Pub. No.: WO2013/180098

PCT Pub. Date: Dec. 5, 2013

(65) Prior Publication Data

US 2015/0157906 A1 Jun. 11, 2015

(30) Foreign Application Priority Data

May 29, 2012 (JP) ..... 2012-122094

(51) Int. Cl.
*A63B 53/10* (2015.01)

(52) U.S. Cl.
CPC ..... *A63B 53/10* (2013.01); *A63B 60/42* (2015.10); *A63B 2209/023* (2013.01)

(58) Field of Classification Search
CPC ... A63B 53/10; A63B 60/42; A63B 2209/023
See application file for complete search history.

(56) References Cited

U.S. PATENT DOCUMENTS 7,918,746 B2 * 4/2011 Kumamoto ..... A63B 53/10 473/319

7,972,223 B2 * 7/2011 Lee ..... A63B 53/10 473/319

(Continued)

FOREIGN PATENT DOCUMENTS

JP 09-140839 A 6/1997
JP 2007-203115 A 8/2007

(Continued)

OTHER PUBLICATIONS

International Search Report dated Aug. 20, 2013, for International Application No. PCT/JP2013/064715.

(Continued)

*Primary Examiner* — Stephen Blau
(74) *Attorney, Agent, or Firm* — Morgan, Lewis & Bockius LLP

(57) ABSTRACT

A golf club shaft which satisfies strength and is lightweight is provided by the present invention. This golf club shaft comprises one or more fiber-reinforced resin layers, and is characterized by satisfying the following relationship (1), wherein x [mm] is the displacement in a cantilever bending test, M [g] is the mass of the golf club shaft, and L [mm] is the length thereof, and by satisfying the following strength standard values [1]-[4]: $M\times(L/1168)<49.66\ e^{-0.0015x}$ (relationship 1); [1] the three-point bending strength at T-90 (the position 90 mm apart from the smaller-diameter end) is 800 N or higher; [2] the three-point bending strength at T-175 (the position 175 mm apart from the smaller-diameter end) is 400 N or higher; [3] the three-point bending strength at T-525 (the position 525 mm apart from the smaller-diameter end) is 400 N or higher; and [4] the three-point bending strength at B-175 (the position 175 mm apart from the larger-diameter end) is 400 N or higher.

3 Claims, 7 Drawing Sheets

(56) References Cited

U.S. PATENT DOCUMENTS

| | | | | |
|---|---|---|---|---|
| 8,777,772 | B2 * | 7/2014 | Hasegawa | A63B 53/10 428/36.3 |
| 2002/0052249 | A1 | 5/2002 | Oyama | |
| 2007/0298902 | A1 | 12/2007 | Hasegawa | |
| 2008/0026868 | A1 | 1/2008 | Takeuchi | |
| 2008/0070716 | A1 | 3/2008 | Kumamoto | |
| 2009/0029792 | A1 | 1/2009 | Kumamoto | |
| 2009/0069109 | A1 | 3/2009 | Kumamoto | |
| 2010/0022324 | A1 | 1/2010 | Kato | |
| 2010/0167833 | A1 | 7/2010 | Sato | |
| 2012/0083357 | A1 | 4/2012 | Sato | |
| 2015/0328507 | A1 * | 11/2015 | Nakamura | A63B 53/00 473/292 |
| 2015/0352416 | A1 * | 12/2015 | Sato | A63B 53/10 473/320 |

FOREIGN PATENT DOCUMENTS

| | | | |
|---|---|---|---|
| JP | 2008-237373 | A | 10/2008 |
| JP | 2009-022622 | A | 2/2009 |
| JP | 2009-219652 | A | 10/2009 |
| JP | 2009-254601 | A | 11/2009 |

OTHER PUBLICATIONS

Partial European Search Report dated May 28, 2015, for corresponding European application No. 13796701.4.

Extended European Search Report dated Oct. 14, 2015, issued in corresponding European Patent Application No. 13796701.4.

* cited by examiner

GOLF CLUB SHAFT FOR WOOD CLUB

TECHNICAL FIELD

The present invention relates to a wood golf club shaft formed of fiber-reinforced resin layers.

This application is based upon and claims the benefit of priority from the prior Japanese Patent application No. 2012-122094, filed on May 29, 2012, the entire contents of which are incorporated herein by reference.

BACKGROUND ART

After a rule of rebound regulations is applied to a golf club head, a method of improving a carry distance is progressing in shaft performance. Most effective means to cover repulsive force of the golf club head is to make a shaft long. A club head speed can be increased by making the shaft long. However, an inertia moment of the club is increased only by simply making the shaft long, so that players may feel the club "heavy" at the time of swing. There is a technique for lightening weight of the club head as a means to solve this problem, but when the weight of the club head is lightened, an impulse is reduced at the time of an impact of the club head with a ball, and thus it is not expected that the carry distance is largely increased. Meanwhile, in the case of lightening the weight of the shaft without changing the weight of the club head, it is possible to reduce only the inertia moment of the club without reducing the impulse at the time of the impact of the club head with the ball. For this reason, a technique for lightening the weight of the shaft has largely received attention.

Patent Document 1 discloses a technique for lightening the weight with paying attention to a bias layer. According to this, in order to improve torsional strength, the bias layer is formed using a material having a thickness of 0.06 mm or less, thereby solving the problem. At this time, a hoop layer is disposed to have two layers in a full length to ensure bending strength. This is because the hoop layer largely contributes to the bending strength.

In Patent Document 2, a length of the hoop layer is disposed to be 20% to 50% of the full length from each of a small-diameter end part and a large-diameter end part of the shaft. As the hoop layer is not present at an intermediate portion, the weight of the shaft is lightened by that much and strength required for shaft characteristics can be ensured at a small-diameter side and a large-diameter side.

A problem in the weight lightening of the golf club shaft is a balance between light weight and strength (three-point bending strength (referred to as SG type three-point bending strength reference in Japan; SG type three-point bending strength test complies with a three-point bending test method prescribed by Consumer Product Safety Association), see FIG. 1). In FIG. 1, a symbol "l" indicates a length of 150 mm in T-90 and a length of 300 mm in T-175, T-525, and B-175. Generally, the bending strength required for the golf club shaft varies depending on positions on a shaft S. Particularly, since shock is applied to a front-end part at the time of the impact, the front-end part requires the largest bending strength. With respect to remaining portions, it is known that an approximately constant value is required from a relation between a rigidity value and the amount of bending. In addition, an individual method or criteria of a strength test is provided by each of club makers, but it is known that it is necessary to satisfy strength reference values of Table 1 in a three-point bending strength test so as to pass such a strength test. That is, a position of T-90 (in the case of the SG type three-point bending strength reference, also referred to as a position T) is a point at which a stress concentration tends to occurs at the time of the impact, a position of T-175 (in the case of the SG type three-point bending strength reference, also referred to as a position A) is a point at which bending deformation tends to increase, a position of T-525 (in the case of the SG type three-point bending strength reference, also referred to as a position B) is a point at which both of a bending load and a crushing load are applied, and a position of B-175 (in the case of the SG type three-point bending strength reference, also referred to as a position C) is a point at which the crushing load is easily applied.

TABLE 1

| Reference strength standard | | | | |
|---|---|---|---|---|
| Designation | T-90 | T-175 | T-525 | B-175 |
| Load point position | From small-diameter end 90 mm | From small-diameter end 175 mm | From small-diameter end 525 mm | From large-diameter end 175 mm |
| Strength reference value [N] | 800 | 400 | 400 | 400 |

When measuring the strength of a shaft which is prepared using the prior art disclosed in Patent Document 1 described above and satisfies the strength reference, sufficient strength can be obtained at the positions of T-90, T-175, and B-175, but a lowest value is indicated at the position of T-525. This is because the position of T-525 is located approximately in the center of the shaft and the bending load, the crushing load are simultaneously applied as described above, and thus there is a tendency that the strength is lowered compared to the positions of T-90, T-175, and B-175. In the case of using Patent Document 2, the strength at T-525 is further lowered. That is, when the shaft is prepared using the prior art, it is necessary that the strength exceeds a reference value of 400 N (40 kgf) in order to satisfy the reference strength standard even at T-525 having the lowest value. However, in this case, the positions of T-90, T-175, and B-175 (particularly, the positions of T-175 and B-175 to be measured under the same span) becomes an excessive strength state, and surplus weight is distributed to these positions.

Patent Document 3 discloses a configuration where a hoop layer has one layer only at the intermediate portion and the hoop layer has two layers in the full length in order to ensure crushing rigidity of the intermediate portion. However, a position of the hoop layer at the intermediate portion is specified in the range not exceeding 45% of the full length from the large-diameter side (the large-diameter side spaced more than 643 mm apart from the small-diameter side when the full length is 1168 mm) Even when the hoop layer of the intermediate portion is disposed at this position, the strength at T-525 is not improved. This is because an object of Patent Document 3 is a speed-up of return bending rather than the weight lightening.

CITATION LIST

Patent Document

Patent Document 1: JP 2007-203115 A
Patent Document 2: JP 2009-219652 A
Patent Document 3: JP 2009-22622 A

DISCLOSURE OF THE INVENTION

Problem to be Solved by the Invention

As described above, since strength distribution is not uniform in the prior art, a portion having the lowest strength needs to satisfy a strength reference value, and a portion having excessive strength (since a surplus member is present in the portion having the excessive strength, the weight is added in surplus due to the surplus member; accordingly, the "portion having the excessive strength" is referred to as "surplus weight") was provided. An object of the invention is to eliminate the surplus weight described above and to prepare a shaft in which the weight is lightened to the utmost limit.

Meanwhile, in general, it is necessary that the shaft needs to be heavier as it becomes stiffer. This is because the shaft becomes brittle and is easily broken as it becomes stiffer, and thus it is necessary to increase the weight by thickening a thickness of the shaft in order to satisfy the same strength reference. In this regard, there is description or suggestion in the citation lists, and even when the same term "lightest weight shaft" is referred, the weight varies due to the stiffness of the shaft. The object of the invention was to prepare a shaft having a lightest weight class for each of types of stiffness.

Means for Solving Problem

As a result of intensive studies in consideration of the above problems, it has been found by present inventors that a further lightweight golf club shaft can be prepared by uniform distribution of strength. In addition, the inventors completed the invention by founding that the shaft having the lightest weight class could be prepared for each of types of stiffness. That is, the invention is as follows. One aspect of the invention will be described below.

(1) A golf club shaft formed of one or more fiber-reinforced resin layers is characterized in that the golf club shaft satisfying Formula 1 below and strength reference values of [1] to [4] below when flex in a cantilever bending test is defined as x [mm], a mass of the golf club shaft is defined as M [g], and a length thereof is defined as L [mm].

$$M\times(L/1168)<49.66e^{-0.0015x} \quad \text{(Formula 1)}$$

[1] Three-point bending strength at T-90, which is a position 90 mm apart from a small-diameter end part, is 800 N or more;

[2] Three-point bending strength at T-175, which is a position 175 mm apart from the small-diameter end part, is 400 N or more;

[3] Three-point bending strength at T-525, which is a position 525 mm apart from the small-diameter end part, is 400 N or more; and

[4] Three-point bending strength at B-175, which is a position 175 mm apart from a large-diameter end part, is 400 N or more.

(2) The golf club shaft described in (1) above satisfies Formula 2 below.

$$M\times(L/1168)<49.20e^{-0.0015x} \quad \text{(Formula 2)}$$

(3) The golf club shaft described in (1) above satisfies Formula 3 below.

$$M\times(L/1168)<46.73e^{-0.0013x} \quad \text{(Formula 3)}$$

(4) The golf club shaft described in any one of (1) to (3) above satisfies Formula 4 below.

$$20\leq M\times(L/1168) \quad \text{(Formula 4)}$$

(5) The golf club shaft described in any one of (1) to (3) above satisfies Formula 5 below.

$$35.97e^{-0.0012x}\leq M\times(L/1168) \quad \text{(Formula 5)}$$

(6) In the golf club shaft described in any one of (1) to (5) above, torsional strength of the shaft is 800 N·m·deg or more.

(7) The golf club shaft described in any one of (1) to (6) above is characterized in that the golf club shaft is formed of one or more fiber-reinforced resin layers and includes: a bias layer that is formed by overlapping fiber-reinforced resin layers, in which orientation directions of reinforcing fibers are ±35° to +55° and −35° to −55° relative to a longitudinal direction of the shaft, with each other; a straight layer that is formed of a fiber-reinforced resin layer in which an orientation direction of the reinforcing fiber is −5° to +5° relative to the longitudinal direction of the shaft; and a hoop layer that is formed of a fiber-reinforced resin layer in which an orientation directions of the reinforcing fiber is +85° to +95° relative to the longitudinal direction of the shaft, wherein the hoop layer is formed of two fiber-reinforced resin layers of a first hoop layer and a second hoop layer, the two hoop layers have an overlapped portion, one end of the overlapped portion is located between 125 mm and 375 mm from the small-diameter end part of the shaft, and the other end of the overlapped portion is located between 675 mm and 925 mm from the small-diameter end part of the shaft.

(8) The golf club shaft described in (7) above is characterized in that one end of the first hoop layer is located at the small-diameter end part of the shaft and the other end thereof is located between 675 mm and 925 mm from the small-diameter end part of the shaft, and one end of the second hoop layer is located between 125 mm and 375 mm from the small-diameter end part of the shaft and the other end thereof is located at the large-diameter end part of the shaft.

(9) In the golf club shaft described in (7) or (8) above, the first hoop layer has a thickness thinner than that of the second hoop layer, and at least one of the straight layer and the bias layer is laminated between the first hoop layer and the second hoop layer.

(10) In the golf club shaft described in any one of (7) to (9) above, the shaft has a thickness Th of 0.7 mm or more and 1.3 mm or less at a position 90 mm apart from the small-diameter end part.

(11) In the golf club shaft described in any one of (7) to (10) above, the small-diameter end part has a shaft outer diameter Rs of 8.0 mm or more and 9.2 mm or less, a length Ls of a straight part in the small-diameter end part is 40 mm or longer and 125 mm or shorter, a tapered degree Tp of a shaft inner diameter is 6/1000 or more and 12/1000 or less, and a shaft inner diameter Rm is 5.20 mm or more and 8.26 mm or less at a position 90 mm apart from the small-diameter end part.

(12) The golf club shaft described in any one of (7) to (11) is characterized in that the golf club shaft includes: a front-end straight reinforcing layer that is formed of a fiber-reinforced resin layer in which an orientation direction of the reinforcing fiber is −5° to +5° relative to the longitudinal direction of the shaft and is configured such that the small-diameter end part of the shaft is a winding start position and an intermediate part thereof is a winding end position; and a rear-end straight reinforcing layer that is configured such that the intermediate part of the shaft is the winding start position and the large-diameter end part thereof is the winding end position, the winding end position of the front-end straight reinforcing layer coincides with a winding start position of the second hoop layer or the front-end straight reinforcing layer and the second hoop layer are partially overlapped with each other, and the winding end position of the rear-end straight reinforcing layer coincides with a winding end position of the first hoop layer or the rear-end straight reinforcing layer and the first hoop layer are partially overlapped with each other.

(13) A golf club shaft formed of one or more fiber-reinforced resin layers is characterized in that the shaft includes: a bias layer that is formed by overlapping fiber-reinforced resin layers, in which orientation directions of reinforcing fibers are +35° to +55° and −35° to −55° relative to a longitudinal direction of the shaft, with each other; a straight layer that is formed of a fiber-reinforced resin layer in which an orientation direction of the reinforcing fiber is −5° to +5° relative to the longitudinal direction of the shaft; and a hoop layer that is formed of a fiber-reinforced resin layer in which an orientation direction of the reinforcing fiber is +85° to +95° relative to the longitudinal direction of the shaft, wherein the hoop layer is formed of two fiber-reinforced resin layers of a first hoop layer and a second hoop layer, the two hoop layers have an overlapped portion, one end of the overlapped portion is located between 125 mm and 375 mm apart from the small-diameter end part of the shaft, and the other end of the overlapped portion is located between 675 mm and 925 mm from the small-diameter end part of the shaft.

(14) The golf club shaft described in (13) above is characterized in that one end of the first hoop layer is located at the small-diameter end part of the shaft and the other end thereof is located between 675 mm and 925 mm from the small-diameter end part of the shaft, and one end of the second hoop layer is located between 125 mm and 375 mm from the small-diameter end part of the shaft and the other end thereof is located at the large-diameter end part of the shaft.

(15) In the golf club shaft described in (13) or (14) above, the first hoop layer has a thickness thinner than that of the second hoop layer, and at least one of the straight layer and the bias layer is laminated between the first hoop layer and the second hoop layer.

An aspect of the invention also includes one of (16) to (30) below.

(16) The golf club shaft described in any one of (1) to (3) above satisfies Formula 6 below.

$$25 \leq M \times (L/1168) \quad \text{(Formula 6)}$$

(17) The golf club shaft described in any one of (1) to (3) above satisfies Formula 7 below.

$$42.40e^{-0.001x} \leq M \times (L/1168) \quad \text{(Formula 7)}$$

(18) The golf club shaft described in any one of (1) to (3) above satisfies Formula 8 below.

$$42.89e^{-0.0009x} \leq M \times (L/1168) \quad \text{(Formula 8)}$$

(19) The golf club shaft described in (8) above is characterized in that the golf club shaft includes: a front-end straight reinforcing layer that is formed of a fiber-reinforced resin layer in which an orientation directions of the reinforcing fiber is −5° to +5° relative to the longitudinal direction of the shaft; and a rear-end straight reinforcing layer, and an overlapped length between a portion in which the first hoop layer is overlapped with the second hoop layer and the front-end straight reinforcing layer and an overlapped length between the portion in which the first hoop layer is overlapped with the second hoop layer and the rear-end straight reinforcing layer are independently 0 to 30 mm.

(20) The golf club shaft described in any one of (8), (10), (11), and (19) above is characterized in that a thickness of the second hoop layer is thicker than that of the first hoop layer.

(21) The golf club shaft described in any one of (8), (9), (10), (11), (19), and (20) above is characterized in that the second hoop layer is located outside the first hoop layer.

(22) The golf club shaft described in any one of (7), (8), (9), (10), (11), (19), (20), and (21) above is characterized in that the bias layer is provided to have two or more layers over a full length of the shaft.

(23) The golf club shaft described in any one of (7), (8), (9), (10), (11), (19), (20), (21), and (22) above is characterized in that the bias layer is provided to have 1.5 or more layers over the full length of the shaft.

(24) The golf club shaft described in (14) above is characterized in that the golf club shaft includes: a front-end straight reinforcing layer that is formed of a fiber-reinforced resin layer in which an orientation directions of the reinforcing fiber is −5° to +5° relative to the longitudinal direction of the shaft; and a rear-end straight reinforcing layer, and an overlapped length between a portion in which the first hoop layer is overlapped with the second hoop layer and the front-end straight reinforcing layer and an overlapped length between the portion in which the first hoop layer is overlapped with the second hoop layer and the rear-end straight reinforcing layer are independently 0 to 30 mm.

(25) The golf club shaft described in (14) or (24) above is characterized in that a thickness of the second hoop layer is thicker than that of the first hoop layer.

(26) The golf club shaft described in any one of (14), (15), (24), and (25) above is characterized in that the second hoop layer is located outside the first hoop layer.

(27) The golf club shaft described in any one of (13), (14), (15), (24), (25), and (26) above is characterized in that the bias layer is provided to have two or more layers over a full length of the shaft.

(28) The golf club shaft described in any one of (13), (14), (15), (24), (25), (26), and (27) above is characterized in that the bias layer is provided to have 1.5 or more layers over the full length of the shaft.

(29) The golf club shaft described in any one of (13), (14), (15), (24), (25), (26), (27), and (28) above is characterized in that the shaft has a thickness Th of 0.7 mm or more and 1.3 mm or less at a position 90 mm apart from the small-diameter end part.

(30) The golf club shaft described in any one of (13), (14), (15), (24), (25), (26), (27), (28), and (29) above is characterized in that the small-diameter end part has a shaft outer diameter Rs of 8.0 mm or more and 9.2 mm or less, a length Ls of a straight part in the small-diameter end part is 40 mm or longer and 125 mm or shorter, a tapered degree Tp of a shaft inner diameter is 6/1000 or more and 12/1000 or less, and a shaft inner diameter is 5.20 mm or more and 8.26 mm or less at a position 90 mm apart from the small-diameter end part.

Effect of the Invention

According to the golf club shaft of the invention, it is possible to further lighten the weight by obtaining uniform strength distribution.

MODE(S) FOR CARRYING OUT THE INVENTION

A golf club shaft according to an aspect of the invention is manufactured using a sheet winding method of heating and forming a fiber-reinforced resin layer (prepreg), in which a resin is impregnated with a sheet-like reinforced fiber obtained by aligning a fiber in one direction and wound around a mandrel several times.

In the invention, examples of fibers used in the fiber-reinforced resin layer can include glass fibers, carbon fibers, aramid fibers, silicon carbide fibers, alumina fibers, and steel fibers. In particular, polyacrylonitrile-based carbon fibers form a fiber-reinforced plastic layer having excellent mechanical properties and thus are most preferred. In addition, reinforcement fibers may be used as a single kind or in combination of two kinds or more.

Although a matrix resin used in the fiber-reinforced resin layer is not particularly limited, epoxy resins are generally used. Examples of the epoxy resins may include bisphenol-A-type epoxy resins, bisphenol-F-type epoxy resins, bisphenol-S-type epoxy resins, phenol novolak type epoxy resins, cresol novolak type epoxy resins, glycidyl amine type epoxy resins, isocyanate modified epoxy resins, and alicyclic epoxy resins. These epoxy resins may be used from in a liquid state to in a solid state. Further, the epoxy resins may be used as a single kind or as a blend of two kinds or more. In addition, the epoxy resins may be preferably used by mixing with a curing agent.

Fiber weight, resin content or the like of the fiber-reinforced resin layer is not particularly limited, and can be selected appropriately depending on a thickness of each layer and a winding diameter.

<Wood Golf Club Shaft>

Figure 8:
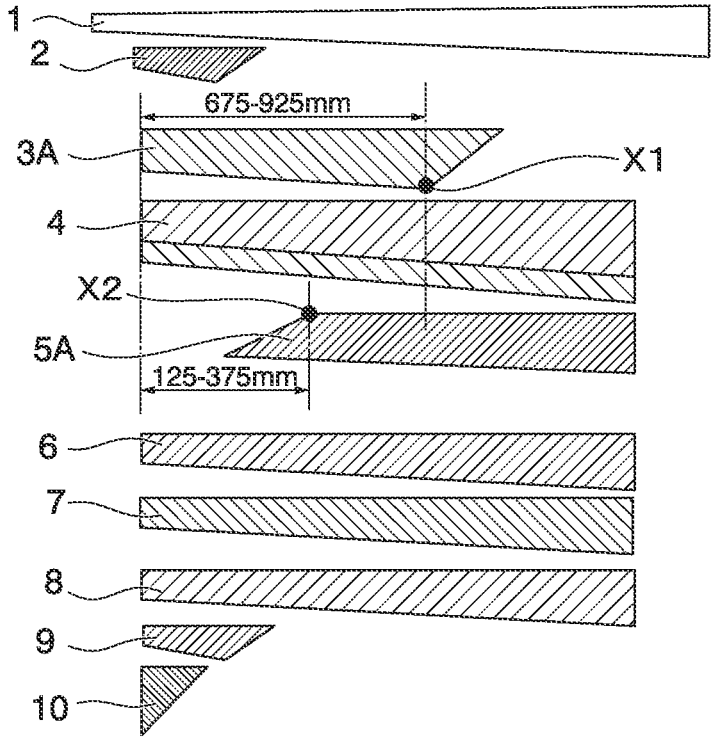
FIG. 8 is a diagram illustrating a mandrel and prepreg used in Examples 1 to 3 of the invention.

Referring to FIG. 8, a wood golf club shaft (hereinafter, simply referred to as a shaft) according to an embodiment of the invention will be described. Each of the following layers (reinforcing layer, hoop layer, bias layer, straight layer, and the like) is a layer formed of the fiber-reinforced resin layer. End parts X1 and X2 indicate end parts of the hoop layer.

In the shaft according to this embodiment, a step-part reinforcing layer 2 is provided at a small-diameter side, and a first hoop layer 3A, a bias layer 4, a second hoop layer 5A, a first straight layer 6, a second straight layer 7, and a third straight layer 8 are successively disposed. Further, a front-end reinforcing layer 9 is disposed at a smaller-diameter-side outer periphery of the third straight layer 8, and an outer diameter adjusting layer 10 is further disposed at the outside thereof so that a predetermined outer diameter can be ensured after finish polishing.

As described in the above (7) and (13), the first hoop layer 3A and the second hoop layer 5A are partially overlapped with each other, one end of the overlapped portion is located between 125 mm and 375 mm from the small-diameter end part of the shaft, and the other end of the overlapped portion is located between 675 mm and 925 mm from the small-diameter end part of the shaft. This is for eliminating surplus weight in T-175 and B-175 while ensuring strength at T-525. In order to shorten the overlapped region described above, when the region in which the hoop layers are overlapped with each other is outside the above range (that is, one end of the overlapped portion is located at a large-diameter-end-part side spaced more than 375 mm apart from the small-diameter end part of the shaft or the other end of the overlapped portion is located at the small-diameter-end-part side spaced less than 675 mm apart from the small-diameter end part of the shaft), it is difficult to obtain the strength at T-525. Further, in order to lengthen the overlapped region described above, the region in which the hoop layers are overlapped with each other is outside the above range (that is, one end of the overlapped portion is located at the small-diameter-end-part side spaced less than 125 mm apart from the small-diameter end part of the shaft or the other end of the overlapped portion is located at the large-diameter-end-part side spaced more than 925 mm apart from the small-diameter end part of the shaft), it is difficult to achieve sufficient weight lightening.

Figure 9:
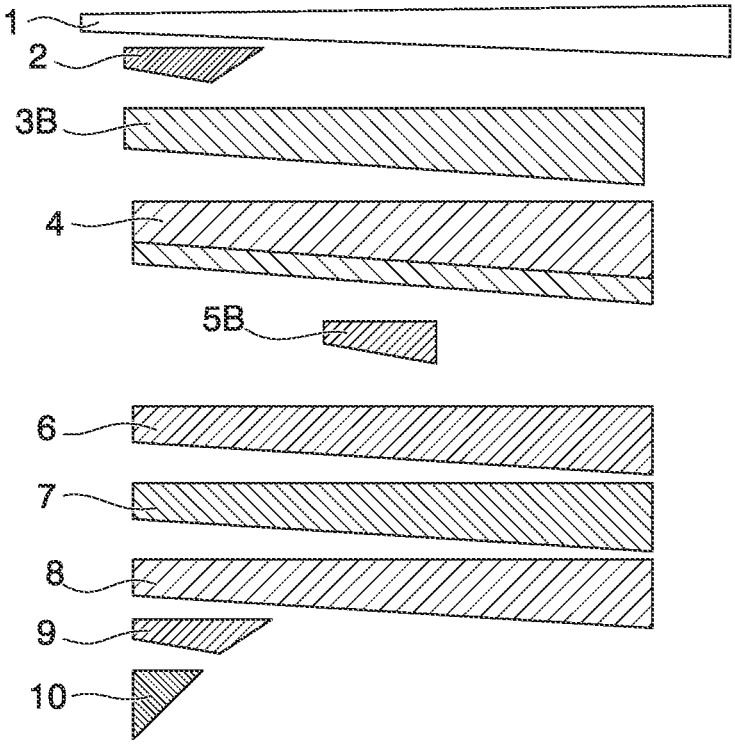
FIG. 9 is a diagram illustrating a mandrel and prepreg used in another example of Examples 1 to 3 of the invention.

Shapes of the first hoop layer 3A and the second hoop layer 5A are not particularly limited, but are preferably formed so as to come in contact with the small-diameter-side end part or the large-diameter-side end part of the shaft, respectively, as described in the above (8) and (14), in terms of handleability, easy winding, and winding accuracy. By the shapes formed in this way, variations in strength become smaller and the weight can be further lightened. When the shapes do not come in contact with the large-diameter-side end part and the small-diameter-side end part, there are possibilities that winding wrinkles may easily occur and the strength may be reduced. In addition, preferably, an extension portion (also referred to as a relief (Nigashi)) of 25 to 100 mm is provided at the other end part of the first hoop layer 3A and the second hoop layer 5A (that is, in the first hoop layer 3A or the second hoop layer 5A, an end part located opposite to the small-diameter-side end part or the large-diameter-side end part of the shaft). When the extension portion (relief) does not exist or is too small, a step occurs at the shaft outer diameter to cause a steep change, and thus the strength may be reduced. When the extension portion (relief) is too large, the weight is increased, and thus it is not preferred. The extension portion (relief) is formed by cutting off the end part of each layer in a triangular shape and is provided to avoid stress concentration and to relieve the stress. The extension portion (relief) is not included in a length of the overlapped portion between the hoop layers. Naturally, as illustrated in FIG. 9, even in the case where the first hoop layer 3B is formed in a full length and the second hoop layer 5B is formed only in an intermediate portion, the same effect is achieved. Even in this case, preferably, the extension portions (relief) are provided at both ends of the second hoop layer 5B.

A stacking order of the first hoop layer 3A and the second hoop layer 5A is not limited, but preferably, the hoop layer of the large-diameter side is disposed outside as much as possible as described in the above (21) and (26). In general, the shaft is flexible at the small-diameter side and is stiff at the large-diameter side. When a bending load is applied, the small-diameter side is large in a deformation ratio of a bending mode, but the large-diameter side is stiff to hardly bend and thus becomes larger in a deformation ratio of a crushing mode. Therefore, the hoop layer effective in crushing is disposed outside, and thus it is possible to obtain the higher strength. Generally, the outside disposition increases areas of the hoop layers, resulting in increasing a contribution to shaft performance. Specifically, the hoop layer is preferably disposed outside relative to the bias layer 4.

However, two or more straight layers are preferably disposed outside the hoop layer. In addition, the straight layers provided outside the hoop layer are preferably equal to or less than seven layers. The shaft is subjected to polishing in the end. For this reason, when two or more straight layers are not provided on an outer layer of the hoop layer, a portion of the hoop layer may be exposed to an outermost layer. When the hoop layer is exposed to the outermost layer, a surface layer of the hoop layer is also polished, which causes the reduction in strength.

On the other hand, the hoop layer of the small-diameter side is preferably disposed inside as described in the above (21) and (26). As described above, since the small-diameter side has the high ratio of the bending mode, the straight layer contributing to the bending is preferably disposed outside. Naturally, since the small-diameter side has also the ratio of crushing, at least one hoop layer is preferably provided. Specifically, the hoop layer is preferably disposed inside relative to the bias layer 4.

In addition, as described in the above (9), (15), (20), and (25), the hoop layer (second layer) disposed at the large-diameter side has preferably a thickness thicker than the hoop layer (first layer) disposed at the small-diameter side. This is because the thick hoop layer has the higher contribution to the crushing and a further uniform strength distribution can be realized by disposing the thick hoop layer at the large-diameter side as described above.

The hoop layers 3A and 5A are layers formed of carbon fiber-reinforced resins and is formed of carbon fibers oriented at an orientation angle of a substantially right angle relative to a longitudinal-axis direction of the shaft. Specifically, as described in the above (7) and (13), the range of substantially right angle is +85° to +95°, which includes forming errors. As the carbon fibers are oriented substantially at right angles, crushing rigidity is improved, resulting in contributing to the strength.

The bias layer 4 is a layer formed of the carbon fiber-reinforced resins and contains carbon fibers oriented at an orientation angle of +35° to +55° relative to the longitudinal-axis direction of the shaft and carbon fibers oriented at an orientation angle of −35° to −55° relative to the longitudinal-axis direction of the shaft. In general, an absolute value of a positive orientation angle is the same as that of a negative orientation angle.

When the orientation angle is too small, the bending rigidity of the shaft is improved. However, in this case, torsional rigidity becomes too small. In addition, when the orientation angle is too large, the crushing rigidity of the shaft is improved, but the torsional rigidity becomes too small.

A positive-orientation-angle layer and a negative-orientation-angle layer constituting the bias layer 4 are preferably attached to each other by substantially shifting half in a circumferential direction. When the positive-orientation-angle layer and the negative-orientation-angle layer are attached to each other without shifting, there are problems that an unevenness of a winding end increases and poor appearance or reduction in strength occurs, which is not preferred. In addition, the positive-orientation-angle layer and the negative-orientation-angle layer constituting the bias layer 4 have preferably a thickness of 0.02 mm or more and 0.08 mm or less, respectively. When the bias layer is too thin, the number of times of winding becomes too many or wrinkles occur at the time of winding, which is not preferred. On the other hand, when the bias layer is too thick, it is necessary to reduce the number of turns for the weight lightening. For this reason, the number of turns becomes insufficient, and there is a possibility that the torsional strength becomes insufficient.

As described in the above (22), (23), (27), and (28), in the shaft, the bias layer is preferably provided to have two or more layers. Further, the bias layer is preferably provided to have seven layers or less. This is derived from a viewpoint of the stability of the torsional strength. As described above, when each of the positive and negative layers is wound with shifting half in the circumferential direction, the bias layer is preferably provided to have 1.5 or more layers. The weight of the shaft can be more lightened as the number of the bias layer becomes less.

The straight layers 6, 7, and 8 are formed over the full longitudinal direction of the shaft. The straight layers are layers formed of carbon fiber-reinforced resins and contain carbon fibers oriented substantially parallel to the longitudinal-axis direction of the shaft. As described in the above (7), (12), (13), (19), and (24), the substantially parallel range is −5° to +5°, which includes forming errors. As the carbon fibers are oriented substantially parallel to the longitudinal-axis direction of the shaft, the bending rigidity can be improved.

In addition, a thickness of a fiber-reinforced resin sheet forming the straight layer is preferably 0.05 to 0.15 mm and more preferably 0.06 to 0.13 mm. It is not possible to improve the bending rigidity when the thickness of the straight layer is too thin, whereas the shaft becomes too heavy and the weight lightening is sufficiently achieved when the thickness is too thick.

The number of straight layers is not limited thereto, but is preferably three or more layers and six layers or less. When the number of straight layers is too few, variation in strength increases and a certain number of shafts below reference strength are prepared. Therefore, a balance between the weight lightening and the strength is difficult. In the case where the number of straight layers is too many, it is necessary to further reduce the thickness of one layer, but it is necessary to lower a volume content of fiber in order to stably produce thin prepreg. In this case, since the weight increases due to the resin, the weight lightening is difficult. Specifically, the volume content of fiber is preferably 60% or more and more preferably 65% or more. In addition, the volume content of fiber in the bias layer 4 is preferably 75% or less and more preferably 70% or less from the fact that a certain degree of resin amounts is required such that matrix resins and reinforcing fibers sufficiently come into close contact with each other.

Examples of resin components constituting the bias layer 4 and the straight layers 6, 7, and 8 may include an epoxy resin, an unsaturated polyester resin, an acrylic resin, a vinyl ester resin, a phenolic resin, a benzoxazine resin or the like. Among these resins, the epoxy resin increases the strength after hardening, which is preferred.

Figure 10:
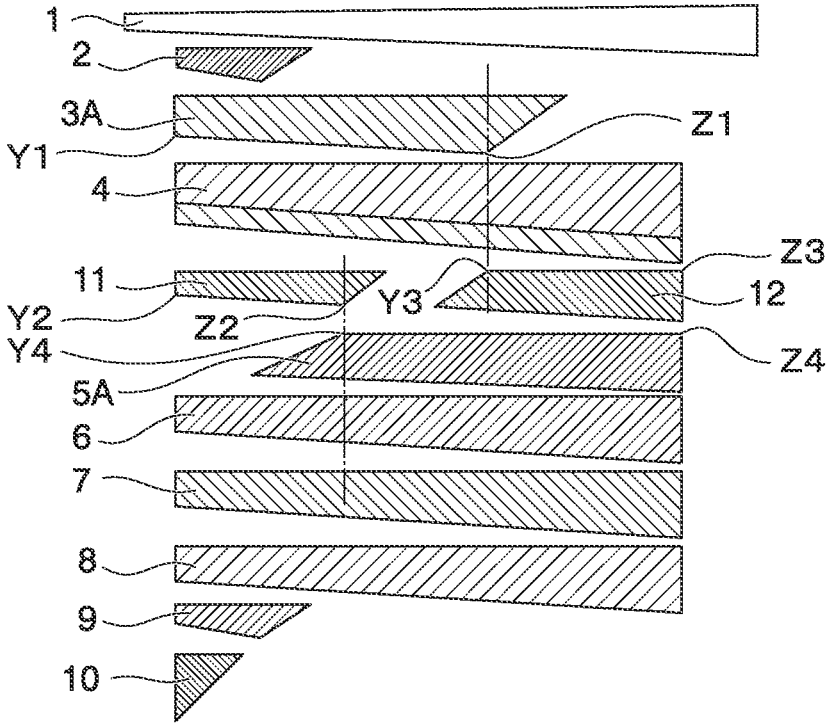
FIG. 10 is a diagram illustrating a mandrel and prepreg used Example 7 of the invention.

Further, as illustrated in FIG. 10, a front-end straight reinforcing layer 11 and a rear-end straight reinforcing layer 12 may be provided. At that time, the front-end straight reinforcing layer 11 and the hoop layer 5A are preferably overlapped with each other, and the rear-end straight reinforcing layer 12 and the hoop layer 3A are preferably overlapped with each other in the same way. The overlapped length is preferably 0 to 30 mm from the viewpoint of the balance between the strength and the weight lightening. In FIG. 10, an end part Y1 is a winding start position of the first hoop layer 3A. An end part Y2 is a winding start position of the front-end straight reinforcing layer 11. An end part Y3 is a winding start position of the rear-end straight reinforcing layer 12. An end part Y4 is a winding start position of the second hoop layer 5A. In addition, an end part Z1 is a winding end position of the first hoop layer 3A. An end part Z2 is a winding end position of the front-end straight reinforcing layer 11. An end part Z3 is a winding end position of the rear-end straight reinforcing layer 12. An end part Z4 is a winding end position of the second hoop layer 5A.

The golf club shaft according to an aspect of the invention is a golf club shaft formed of one or more fiber-reinforced resin layers and is characterized by satisfying Formula 1 below and strength reference values of [1] to [4] below when flex in a cantilever bending test is defined as x [mm], a mass of the golf club shaft is defined as M [g], and a length thereof is defined as L [mm]

$$M\times(L/1168)<49.66e^{-0.0015x} \quad \text{(Formula 1)}$$

[1] Strength at T-90 (a position 90 mm apart from the small-diameter end part) is 800 N or more

[2] Strength at T-175 (a position 175 mm apart from the small-diameter end part) is 400 N or more

[3] Strength at T-525 (a position 525 mm apart from the small-diameter end part) is 400 N or more

[4] Preferably, strength at B-175 (a position 175 mm apart from the large-diameter end part) is 400 N or more, and the strength at T-90 is 1200 N or less. The strength at T-175 is preferably 1200 N or less. The strength at T-525 is preferably 1200 N or less. The strength at B-175 is preferably 1200 N or less.

The length of the golf club shaft according to the aspect of the invention is preferably 1092 mm or longer, and is preferably 1194 mm or shorter.

<Method of Cantilever Bending Test>

Figure 1:
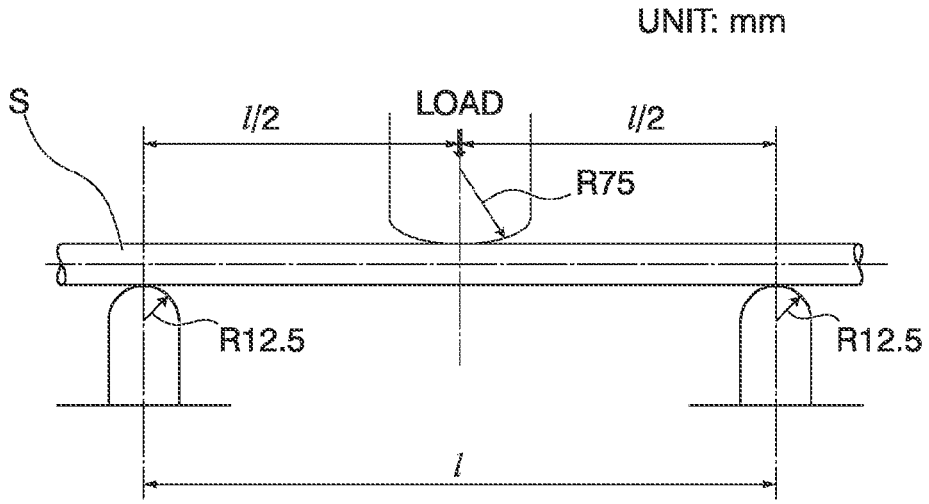
FIG. 1 is a schematic diagram illustrating a measuring method of three-point bending strength.
Figure 2:
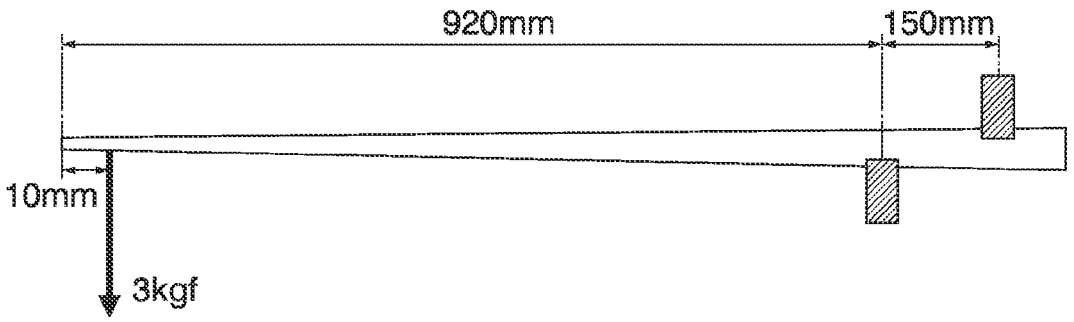
FIG. 2 is a schematic diagram illustrating a testing method of flex x in a cantilever bending test.

As illustrated in FIG. 2, the shaft is supported from a lower side at a position 920 mm apart from the end part of the small-diameter side and is supported from an upper side at a position 150 mm further apart therefrom in the large-diameter side direction (a position 1070 mm apart from the end part of the small-diameter side), and a load of 3.0 kgf is dropped to the shaft at a position 10 mm apart from the small-diameter side. At this time, flex of the small-diameter-side end part denotes "flex x in the cantilever bending test" according to the invention, which is in mm.

In the aspect of the invention, M×(L/1168) indicates a conversion mass when the length of the shaft is 1168 mm. Since general wood golf club shafts have different length according to makers or models, it is difficult to simply indicate a relation between weight and strength. Accordingly, the conversion mass was used. In some cases, the conversion mass will be described using "y" as in M×(L/1168)=y in the following description including the drawings.

Figure 3:
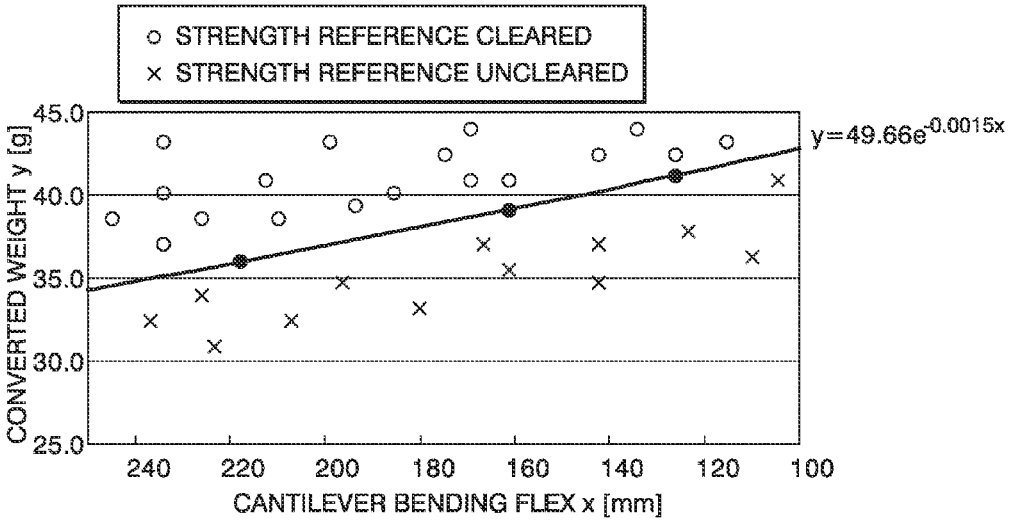
FIG. 3 is a diagram illustrated by plotting relationship of results obtained in the case of using a prior art.

FIG. 3 illustrates results obtained by performing a three-point bending strength test on a shaft having various kinds of weight and stiffness which is prepared using a material (carbon fiber-reinforced resin layer having an elastic modulus of 295 GPa) considered to be most suitable for the weight lightening at the present state in the prior art. White circles indicate that the strength reference is satisfied, and x-marks indicate that the strength reference is not satisfied. In this way, a line of $y=49.66\ e^{-0.0015x}$ represents a line of the lightest weight to achieve a reference strength standard in the prior art. The line of $y=49.66\ e^{-0.0015x}$ was obtained by the following manner.

(i) Six shafts were each prepared which had the flex x of 215 mm, 160 mm, and 125 mm measured by the cantilever bending test, satisfied the reference strength standard in the prior art, and had the lightest weight. Specifically, the shafts having the flex x of 215 mm, 160 mm, and 125 mm measured by the cantilever bending test were prepared as in Comparative Example 1, Comparative Example 2, and Comparative Example 3 to be described below, respectively.

(ii) The weight of each shaft was measured and an average value of the weight per the shaft having each variation quantity was obtained.

(iii) In the formula y=M×(L/1168), "M" was substituted by the average value of the weight of the shaft obtained in the above (ii), thereby obtaining values of y in the variation quantity x of 215 mm, 160 mm, and 125 mm.

(iv) An approximate formula was obtained in the form of an exponential function by approximating three points of y obtained in the above (iii) according to a least-squares method.

The approximate formula is not necessarily required to use the exponential function, but the exponential function represents phenomena well. In addition, as indicated in the above (iii), even when the full length of the shaft is changed, the values obtained at T-90, T-175, T-525, and B-175 may be also used without any trouble so long as the full length is in the range of 1092 to 1194 mm.

In addition, variation may generally occur in the range of ±3 σ in the three-point bending test. Then, the weight may be below $y=49.66\ e^{-0.0015x}$ due to the variation even in the prior art. In order to eliminate this concern, it is preferred that the golf club shaft satisfies the range of Formula 2 below.

$$M\times(L/1168)<49.20e^{-0.0015x} \quad \text{(Formula 2)}$$

The higher strength is required as the rigidity (stiffness) of the shaft becomes higher. Generally, this is because persons having a high club head speed tend to use the stiff shaft. Therefore, the golf club shaft is preferred to satisfy the range of Formula 3 below.

$$M\times(L/1168)<46.73e^{-0.0013x} \quad \text{(Formula 3)}$$

In addition, when the conversion mass is less than 20 g, players likely to feel discomfort at the time of swing, resulting in unsatisfactorily acting as a shaft. For this reason, the golf club shaft is preferred to satisfy the range of Formula 4 below.

$$20\leq M\times(L/1168) \quad \text{(Formula 4)}$$

Further, since the swing is easy when the conversion mass is 25 g or more, the golf club shaft is preferred to satisfy the range of Formula 6 below.

$$25\leq M\times(L/1168) \quad \text{(Formula 6)}$$

In addition, when the lightest weight shaft is prepared using the aspect of the invention, M×(L/1168), which is the conversion mass, was recorded as 28.1 g, 30.5 g, and 31.5 g in the shafts having the flex x of 215 mm, 160 mm, and 125 mm measured by the cantilever bending test. These three points are approximated in the form of the exponential function using the least-squares method, which may be referred to as lower limit values of the conversion mass. That is, the lower limit values are more preferred to satisfy Formula 5 below.

$$35.97e^{-0.0012x}\leq M\times(L/1168) \quad \text{(Formula 5)}$$

When the lightest weight shaft is prepared in a more stably manner, the lower limit values of the conversion mass are preferred to satisfy Formula 7 below.

$$42.40e^{-0.001x}\leq M\times(L/1168) \quad \text{(Formula 7)}$$

Further taking the variation into consideration, the lower limit values of the conversion mass are more preferred to satisfy Formula 8 below.

$$42.89e^{-0.0009x}\leq M\times(L/1168) \quad \text{(Formula 8)}$$

Figure 4:
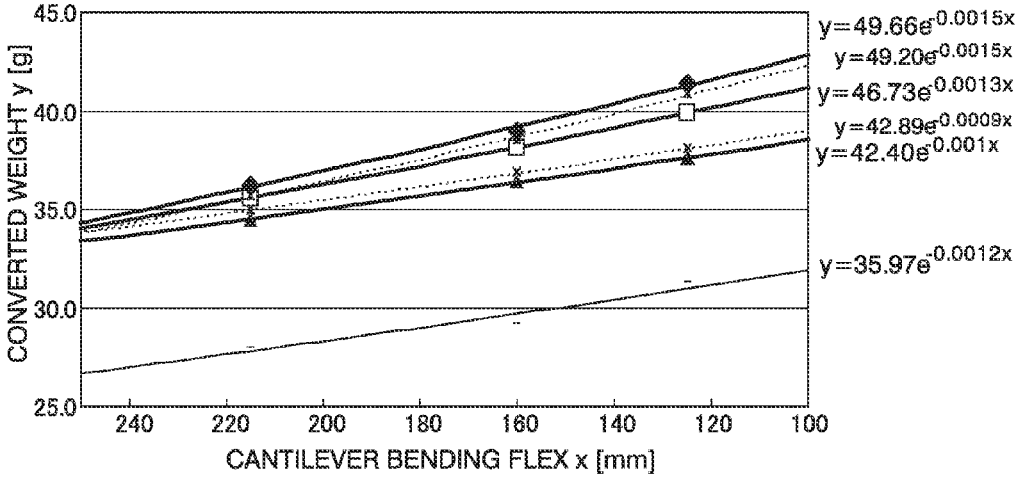
FIG. 4 is a diagram illustrating formulas of boundary lines used in an aspect of the invention.

The foregoing formulas were graphically illustrated in FIG. 4.

As described above, it is possible to achieve more accurately the weight, rigidity, and strength, which have been difficult to achieve in the prior art, using the technique of the invention.

As can be confirmed from FIG. 4, a stiff shaft has a larger difference from the prior art, compared to a flexible shaft. That is, since the invention is significantly applied to the stiff shaft compared to the flexible shaft, the invention can be applied to a shaft having the rigidity of preferably 160 mm or less and more preferably 125 mm or less. In addition, it is preferred to apply to a shaft having the rigidity of 100 mm or more.

An example of a method of manufacturing the golf club shaft satisfying the above condition is described, but the invention is not limited to the following manufacturing method.

First, basic matters, that is, basic properties, a description of each layer, and factors affecting the strength of the golf club shaft will be described.

<Basic Properties of Golf Club Shaft>

The heavier the weight, the higher the strength: the lighter the weigh, the lower the strength (under the same stiffness)

The more the shaft is flexible, the lighter the weight: the stiffer the shaft, the heavier the weight (under the same strength)

The more the shaft is flexible, the higher the strength: the stiffer the shaft, the lower the strength (under the same weight)

<Description of Each Layer of Golf Club Shaft>

An angle layer has an influence on the difficulty in torsion. As materials having a high elastic modulus are used, the torsion becomes difficult, but when the elastic modulus is high, the shaft becomes brittle and is easily broken. Even in the case of materials having a low elastic modulus, as the layer is thickly formed in a multi-layer, the torsion becomes difficult. However, when the layer is thickly formed in the multi-layer, the golf club shaft becomes heavy.

The straight layer has an influence on the difficulty in bending. As the materials having the high elastic modulus are used, the bending becomes difficult (the layer becomes stiff), but when the elastic modulus is high, the shaft becomes brittle and is easily broken. Even in the case of the materials having the low elastic modulus, as the layer is thickly formed in a multi-layer, it becomes stiff. However, when the layer is thickly formed in the multi-layer, the golf club shaft becomes heavy.

The hoop layer has an influence on the difficulty in strength. As the materials having the high elastic modulus are used, the strength is increased, but when the elastic modulus is high, the shaft becomes brittle and is easily broken. Even in the case of the materials having the low elastic modulus, as the layer is thickly formed in a multi-layer, the strength is increased. However, when the layer is thickly formed in the multi-layer, the golf club shaft becomes heavy.

<Factors Affecting Strength of Golf Club Shaft>

In addition to the hoop layer, the angle layer and the straight layer also affect the strength of the golf club shaft. Conditions for increasing the strength of the golf club shaft are as follows:

The elastic modulus of the angle layer is low.

The angle layer is thick.

The elastic modulus of the straight layer is low.

The straight layer is thick.

The elastic modulus of the hoop layer is high.

The hoop layer is thick.

The basic idea is that "the heavier the weight, the higher the strength, and the lighter the weight, the lower the strength". However, since the degree of contribution to the strength is different for each layer, the design is made by appropriately adjusting according to the aim of the weight or the stiffness. Specifically, measures are taken as follows.

<<Measures to be Taken when Weight of Golf Club Shaft is Too Heavy>>

Figure 5:
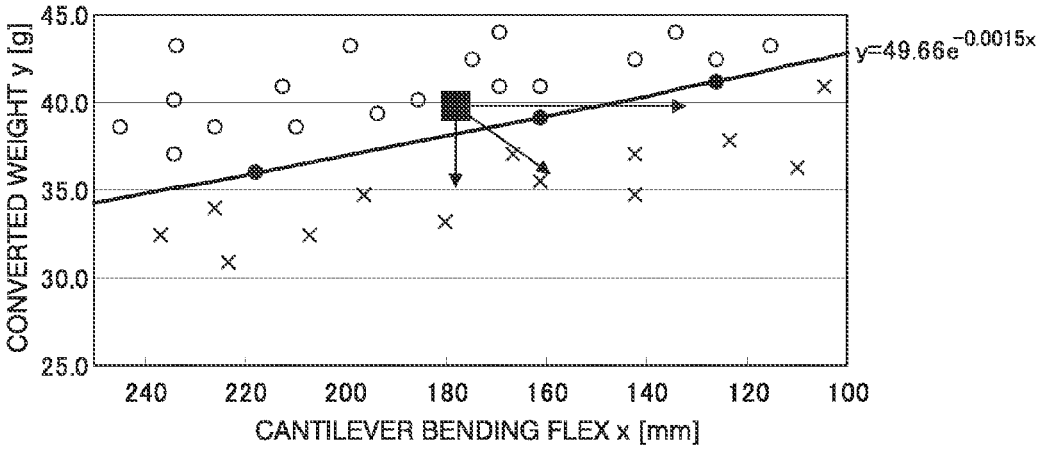
FIG. 5 is a diagram illustrating a direction of weight lightening to be achieved in the aspect of the invention.

For example, a shaft of the weight: 40 g and the flex: 180 mm in the cantilever bending test is considered (black square in FIG. 5). When a person skilled in the art intends to lighten the weight of such a shaft up to that of the golf club shaft of the invention (in order to satisfy the above condition of Formula 2 in one aspect of the invention), the following method is considered, but the intent that the weight cannot lightened by the existing method will be described below.

Prior method A: To fix the rigidity and to lighten only the weight (designed in a direction of a downward arrow in FIG. 5)

Prior method B: To fix the weight and to stiffen only the rigidity (designed in a direction of a right arrow in FIG. 5)

Prior method C: A compromise plan between the prior method A and the prior method B The method of the cantilever bending test is as described above, and the flex x measured by the cantilever bending test is sometimes referred to as the "rigidity" in the invention.

<Prior Method A>

For example, when the prior method A is employed, the design corresponds to the following conditions:

(i) To make the angle layer thin.

Figure 6:
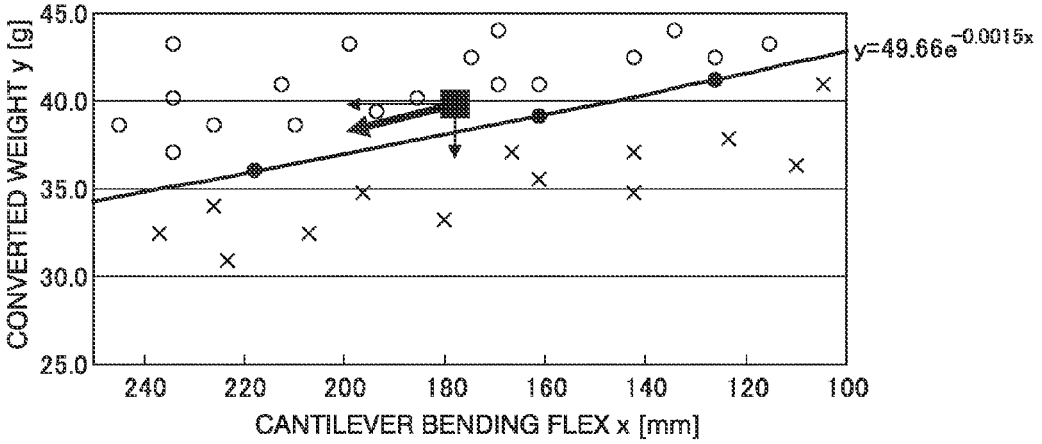
FIG. 6 is a diagram illustrating a direction of weight lightening in the case of using the prior art.

(ii) To form the straight layer using stiff materials while making it thin (when the straight layer is formed only to be thin, since the shaft is designed as "a direction of, for example, a left-slanted downward arrow" in FIG. 6, the weight is not lightened).

At this time, even when any one of the conditions (i) and (ii) is employed, the strength decreases.

<Prior Method B>

For example, when the prior method B is employed, the design corresponds to the following conditions:

(iii) To form the straight layer using stiff materials.

(iv) To make a mandrel thick and to make the entire shaft thick.

At this time, even when any one of the conditions (iii) and (iv) is employed, the strength decreases.

<Prior Method C>

For example, when the prior method c is employed, the design corresponds to the following conditions:

(v) To simultaneously perform the condition (i) in the method A and the condition (iii) or (iv) in the method B. At this time, the degree of the conditions (i), (iii), and (iv) is appropriately changed.

(vi) To simultaneously perform the condition (ii) in the method A and the condition (iii) or (iv) in the method B. At this time, the degree of the conditions (ii), (iii), and (iv) is appropriately changed.

For example, when attempting to achieve the weight lightening while ensuring the strength in the same manner as the prior art disclosed in Patent Document 1, the strength at T-90, T-175, and B-175 is cleared, but the strength at T-525 is insufficient (that is, the line of $y=49.66\ e^{-0.0015x}$ becomes a line of the lightest weight for achieving the strength at T-525 in the prior art).

In addition, when the weight lightening of the shaft having the weight: 40 g and the flex: 180 mm in the cantilever bending test is achieved as follows using the prior art (FIG. 6).

<1> In the case of lightening the weight (designed in a direction of a downward arrow in FIG. 6), it is necessary to use materials having a high elastic modulus or to reduce materials to be used. If the materials having the high elastic modulus are used, the shaft becomes brittle and thus has necessarily insufficient strength. Accordingly, it is necessary to reduce the materials to be used.

<2> In the case of reducing the materials to be used without changing the elastic modulus, the shaft becomes flexible.

<3> As a result, the relation between the weight and the stiffness advances in a lower left direction (designed in a direction of a left-slanted downward arrow in FIG. 6) and may not exceed the line of $49.66\ e^{-0.0015x}$.

As described in <1> to <3>, according to the prior design, it may be impossible to lighten only the weight while maintaining the stiffness and the strength.

In the invention, the strength at T-90, T-175 and B-175, which tends to be excessive, is reduced and the insufficient strength at T-525 is compensated, resulting in taking the balance between the weight lightening and the strength, which could not be achieved until now. Specifically, the weight and the strength can be positioned in a range lower than an upper limit of Formula 1 described above by providing an arrangement, materials, and a laminated structure of the angle layer, the straight layer, and the hoop layer according to the arrangement, the materials, and the laminated structure of the invention.

An object of the invention is to achieve both of the light weight and the strength, based on the above description.

Hereinafter, specific designs will be further described.

<Design of Mandrel>

After heating and hardening a fiber-reinforced resin layer wound around a core to be called a mandrel, a golf club shaft can be obtained by pulling out the mandrel. For this reason, the relation between a diameter and a thickness of the mandrel and the shaft is as follows.

Inner diameter of golf club shaft=outer diameter of mandrel

Thickness of shaft=(outer diameter of shaft− outer diameter of mandrel)×½

In addition to the laminated structure, since the mandrel has a large influence on the rigidity, the weight, and the strength (since the thickness of the shaft has an influence), a design of the mandrel will be described below.

"With Respect to T-90"

It is apparent from studies until now that the strength at T-90 generally depends on the thickness thereat. Since T-90 indicates a position of 90 mm from the small-diameter end part, the strength at T-90 is mostly determined if the diameter of small-diameter end part of the shaft is determined That is, the following equation is satisfied.

$$Rm=Rs-Ls\times Tp-Th$$

Rm: mandrel outer-diameter at T-90=shaft inner-diameter at T-90

Rs: shaft outer diameter at small-diameter end part

Ls: length of straight portion (the straight portion of the small-diameter end part having the same diameter only at a normally certain range is formed in consideration of an insertion into the club head.)

Tp: tapered degree of mandrel (the thickness at T-90 is also different depending on Tp)

Th: thickness at T-90

A mandrel is designed such that the thickness of the shaft at T-90 is 0.7 mm or thicker and 1.3 mm or thinner using the above equation. This is because the strength is insufficient when the thickness of the shaft is too thin and because the weight of the shaft becomes large when the thickness is too thick.

As described above, the following ranges are satisfied:

From the viewpoint of the strength and the weight, 0.7 mm≤Th≤1.3 mm;

From a normal standard range of a wood golf club shaft, 8.0 mm≤Rs≤9.2 mm;

From a tapered range of a mandrel to be usually used, 6/1000≤Tp≤12/1000; and

From the viewpoint of the straight portion of the small-diameter end part necessary for the insertion of the club head, 40 mm≤Ls≤125 mm.

From the above, the range of Rm is generally as follows.

5.2 mm≤Rm≤8.26 mm

In addition, further taking the balance between the strength and the weight into consideration, the following ranges are more preferred.

0.9 mm≤Th≤1.1 mm 8.3≤mm Rs≤8.9 mm

8/1000≤Tp≤10/1000

60 mm≤Ls≤100 mm 6.2 mm≤Rm≤7.2 mm

"With respect to T-175 and T-525"

Any diameter may be employed in view of the balance between the rigidity, the weight, and the strength. When the diameter is thick, the rigidity is increased by that much, but the strength is correspondingly lowered. Thus, it is necessary to maintain predetermined strength by increasing the weight (increasing the thickness). When the diameter is thin, the rigidity is reduced, but it is necessary to provide a difference between the invention and the prior art by aiming achievement of further lightening the weight.

In view of the above, T-175 and T-525 are the same even for any diameter of the mandrel.

"With respect to B-175"

With respect to B-175, any diameter is also possible as in T-175 and T-525, but the diameter is preferably 13.0 to 15.0 mm and more preferably 13.5 to 14.5 mm. At B-175, as in T-175 and T-525, the thicker the diameter, the higher the rigidity, but the degree of contribution is higher compared to T-175 and T-525. For this reason, it is difficult to obtain sufficient rigidity when the thickness is too thin, and it is difficult to obtain sufficient strength when the thickness is too thick.

<Selection of Angle Layer>

A thickness of a fiber-reinforced resin sheet forming the angle layer is preferably 0.060 mm or less and more preferably 0.050 mm or less. In addition, the thickness of the fiber-reinforced resin sheet forming the angle layer is preferably 0.005 mm or more. When the angle layer is too thick, it is difficult for the angle layer to be wound to have 1.5 layers or more (since a positive orientation angle and a negative orientation angle are paired, the angle layer has virtually three layers. In the case where the angle layer does not satisfy 1.5 layers, there is a high possibility of breakage due to torsional fracture even when satisfying the bending strength reference. When the fiber-reinforced resin sheet forming the angle layer is too thick, if the angle layer is wound to have 1.5 layers or more, it becomes overweight. The breakage due to the torsional fracture depends on the number of angle layers, a reference value of which is generally 1.5 layers. As described above, in the case where the angle layer is wound to have 1.5 layers with the thickness of 0.10 mm, it becomes overweight. In the case where the thickness of the fiber-reinforced resin sheet is 0.060 mm, even when the angle layer is wound to have 1.5 layers, it does not become overweight.

As the elastic modulus of the fiber-reinforced resin sheet forming the angle layer, it is preferable to have 280 to 400 GPa. When the elastic modulus is too low, the torsional strength increases, but a torsional angle (torque) becomes large. Accordingly, in this case, it is difficult to obtain preferred performance as the golf club. For this reason, the torque is preferably 8° or less. In addition, the torque is preferably 4° or more. When the elastic modulus is too high, it becomes brittle, and thus there is a possibility that the torsional strength is insufficient.

A method of measuring the torque is as follows.

[Method of Measuring Torque]

Figure 12:
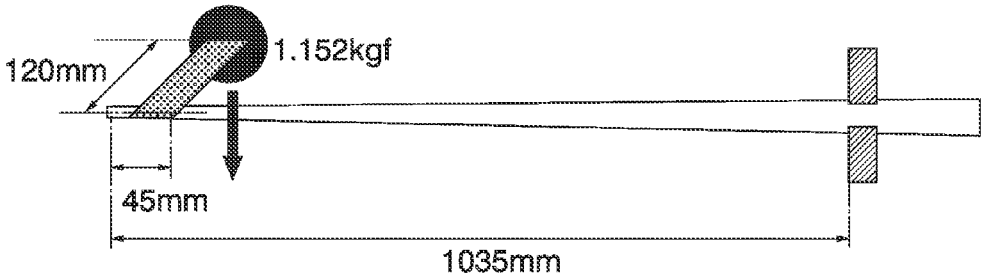
FIG. 12 is a schematic diagram illustrating a method of measuring torque.

As illustrated in FIG. 12, a position 1035 mm apart from the end part of the small-diameter side of the shaft is fixed and a torsional load is applied to a position of 45 mm. The magnitude of the torsional load is defined by applying a magnitude of 1.152 kgf to a position 120 mm apart from an axial line of the shaft. At this time, the torsional angle of the small-diameter-side end part of the shaft is defined as the torque.

[Torsional Strength]

Figure 13:
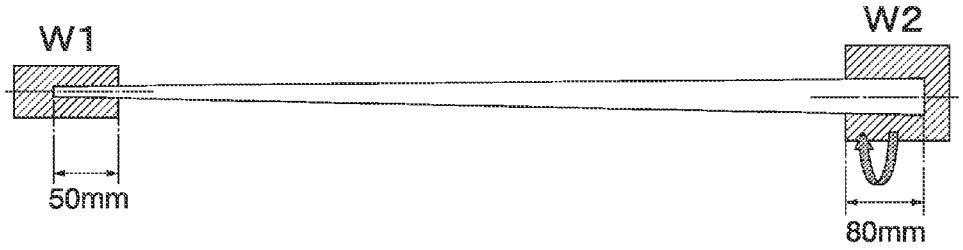
FIG. 13 is a schematic diagram illustrating a method of measuring torsional strength.

The torsional strength is measured by multiplying a weighed value when the shaft is fractured at the time of adding a torsional weight by a fracture angle at that time. FIG. 13 is a diagram schematically illustrating a method of measuring the torsional strength. In the method of measuring the torsional strength, a small-diameter end part W1 and a large-diameter end part W2 of a shaft are fixed. As in the bending strength, the reference value is preferably 800 N·m·deg or more in general. More preferably, the reference value is 1000 N·m·deg or more. In addition, the torsional strength is preferably 3000 N·m·deg or less and more preferably 2000 N·m·deg or less.

<Selection of Straight Layer>

Preferably, the straight layer has at least three layers. More preferably, the straight layer has four layers or more. This is because a multilayer structure has small variation in the strength. On the other hand, when the straight layer is too multi-layered, a thin material is required and the volume content of the fiber is reduced in terms of manufacturability of the prepreg. Therefore, the straight layer preferably has seven layers or less and more preferably has six layers or less. In the case of two layers or less, since the variation in the strength is too large, it is extremely difficult to seek a limit value of the strength.

At least one layer of the fiber-reinforced resin sheet forming the straight layer preferably uses a middle-elasticity grade of 280 to 330 GPa, and two layers or more preferably have the middle-elasticity grade. In addition, at least one layer preferably has a high-strength grade of 220 to 250 GPa. When all of the layers are produced with the high-strength grade, there is a possibility of being overweight. Preferably, the shaft is produced such that at least one layer has the middle-elasticity grade of 280 to 330 GPa and the remaining layers have the high-strength grade of 220 to 250 GPa in terms of the strength. When the high-elasticity grade exceeding 330 GPa is used, the shaft becomes stiff and brittle, and thus there is a high possibility that the strength is insufficient. Even if numerical strength is achieved, there is a risk of breakage when is actually used. For this reason, the use of the high-elasticity grade exceeding 330 GPa should be avoided.

<Selection of Hoop Layer>

The hoop layer is formed of two fiber-reinforced resin layers, and the two fiber-reinforced resin layers are partially overlapped with each other. Preferably, one end of the overlapped portion is located between 125 mm and 375 mm from the small-diameter end part of the shaft, and the other end thereof is located between 675 mm and 925 mm from the small-diameter end part of the shaft.

When one end of the overlapped portion described above is located at the small-diameter-end-part side spaced less than 125 mm apart from the small-diameter end part, since the overlapped region becomes longer, the surplus weight occurs and the weight of the shaft increases. Even when the other end of the overlapped portion is located at the large-diameter-end-part side spaced more than 925 mm apart from the small-diameter end part, since the overlapped region becomes longer, the surplus weight occurs and the weight of the shaft increases. In addition, when the strength is measured at T-525, since the three-point bending test is performed at positions ±150 mm away from around the position 525 mm apart from the small-diameter end part, if the overlapped portion of the hoop reinforcing layers is not present at a region at least 375 to 675 mm apart from the small-diameter end part of the shaft, the strength becomes insufficient. The overlapped configurations described above may include those formed by (1) and (2) below, for example, (1) a method of forming such that the first hoop layer 3A comes in contact with the end part of the small-diameter side and the second hoop layer 5A comes in contact with the end part of the large-diameter side as illustrated in FIG. 8 and (2) a method of forming by the first hoop layer 3B over the full length and the second hoop layer 5B not having both ends as illustrated in FIG. 9.

The thickness of the fiber-reinforced resin sheet forming the hoop layer is preferably 0.025 to 0.065 mm. The strength becomes insufficient when the thickness is too thin, and it is overweight when the thickness is too thick.

In addition, the fiber-reinforced resin sheet forming the hoop layer preferably has the elastic modulus of 220 to 400 GPa. It is difficult to obtain sufficient strength when the elastic modulus is too low, and static strength is easily obtained when the elastic modulus is high, but it becomes brittle with dynamic strength when exceeding the upper limit value of the range described above.

Further, the hoop layer to be disposed at the large-diameter side of the shaft is preferably wound outside as far as possible. This is because the strength of the shaft is significantly increased when the hoop layer to be disposed at the large-diameter side is wound outside. With respect to each hoop layer, it is considered that the thickness thereof most contributes to the strength, but the elastic modulus thereof also slightly contributes to the strength of the shaft. For this reason, the elastic modulus of the fiber-reinforced resin sheet forming the hoop layer is preferably 200 to 400 GPa. When the elastic modulus is too low, there is a possibility that the strength becomes insufficient when the shaft is prepared. When the elastic modulus is too high, it becomes a brittle material, and thus there is concern that the rate of breakage increases.

In addition, the flexible shaft having a low rigidity tends to have the lowest strength at T-525 and to have the same strength at T-175 and B-175, but the stiff shaft having a relatively high rigidity tends to have the lowest strength at T-525, to have the second lowest strength at T-175, and to have the highest strength at B-175. Therefore, the thickness of the fiber-reinforced resin sheet forming the hoop layer of the small-diameter side to be used in the flexible shaft (longer than 160 mm) having the low rigidity is preferably 0.02 to 0.04 mm. The strength becomes insufficient when the thickness is too thin, and the weight is increased too much when the thickness is too thick.

In the stiff shaft (160 mm or shorter) having the high rigidity, the thickness of the fiber-reinforced resin sheet forming the hoop layer of the small-diameter side is preferably 0.045 to 0.07 mm. The reason is the same as described above.

The thickness of the fiber-reinforced resin sheet forming the hoop layer of the large-diameter side is preferably 0.045 to 0.07 mm in any rigidity. In the scope of the invention, there is no significant difference due to the elastic modulus of the hoop layer and the thickness of the hoop layer is an important factor.

EXAMPLES

The invention will be described below in detail through Examples, but the invention is not limited to the following Examples.

As the fiber-reinforced resin layer described above, for example, carbon prepreg (manufactured by Mitsubishi Rayon Co., Ltd.) indicated in Table 2 can be used.

TABLE 2

| Prepreg | Product number | Tensile elastic modulus (GPa) | Weight ($g/m^2$) | Resin content (mass %) | Thickness (mm) |
|---|---|---|---|---|---|
| A | TR350C075S | 235 | 75 | 25 | 0.062 |
| B | TR350C100S | 235 | 100 | 25 | 0.083 |
| C | TR350C125S | 235 | 125 | 25 | 0.103 |
| D | TR350C150S | 235 | 150 | 25 | 0.124 |
| E | TR350C175S | 235 | 175 | 25 | 0.145 |
| F | TR350J050 | 235 | 54 | 37.4 | 0.058 |
| G | TR350E100R | 235 | 100 | 30 | 0.091 |
| H | TR350E125S | 235 | 125 | 30 | 0.113 |
| I | TR350E150S | 235 | 150 | 30 | 0.136 |
| J | MR350C050S | 295 | 58 | 25 | 0.05 |
| K | MRX350C075R | 295 | 75 | 25 | 0.063 |
| L | MRX350C100R | 295 | 100 | 25 | 0.085 |
| M | MRX350C125R | 295 | 125 | 25 | 0.106 |
| N | MRX350C150R | 295 | 150 | 25 | 0.127 |
| O | MRX350K020S | 295 | 23 | 40 | 0.026 |
| P | MRX350J050S | 295 | 54 | 37.5 | 0.058 |
| Q | HRX350C050S | 390 | 58 | 25 | 0.048 |
| R | HRX350C075S | 390 | 69 | 25 | 0.057 |
| S | HRX350C100S | 390 | 92 | 25 | 0.076 |
| T | HRX350C125S | 390 | 116 | 25 | 0.096 |
| U | HSX350C050S | 450 | 58 | 25 | 0.047 |
| V | HSX350C075S | 450 | 69 | 25 | 0.056 |
| X | HSX350C100S | 450 | 92 | 25 | 0.075 |
| Y | HSX350C125S | 450 | 116 | 25 | 0.095 |

Comparative Example 1

Figure 7:
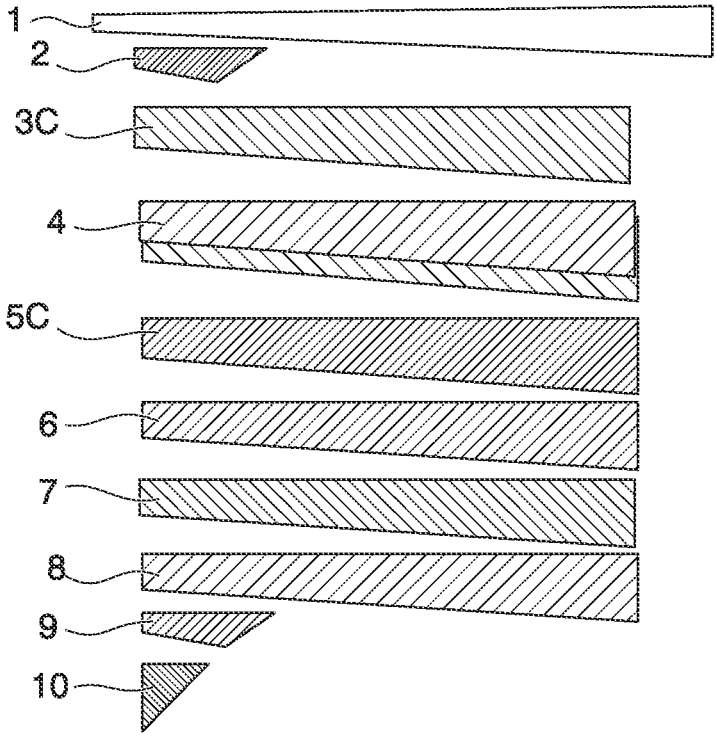
FIG. 7 is a diagram illustrating a mandrel and prepreg used in Comparative Examples 1 to 3 of the invention.

FIG. 7 is a schematic diagram illustrating a laminated structure in Comparative Example 1 of the invention.

After heating and hardening prepreg sequentially wound around an iron core to be called a mandrel 1, a shaft can be obtained by pulling out the mandrel 1.

The mandrel 1 has the full length of 1500 mm, and the diameter thereof is as follows, counted from the small-diameter side.

Diameter at a position 0 mm apart from the small-diameter side: 4.80 mm

Diameter at a position 180 mm apart from the small-diameter side: 6.45 mm

Diameter at a position 280 mm apart from the small-diameter side: 7.95 mm

Diameter at a position 950 mm apart from the small-diameter side: 14.00 mm

Diameter at a position 1500 mm apart from the small-diameter side: 14.00 mm

In Examples and Comparative Examples of the invention, the shaft was obtained using the mandrel 1 described above in such a manner that after heating and hardening the prepreg sheet wound around the mandrel from a position 120 mm apart from the small-diameter end part of the mandrel at a full length of 1190 mm, the mandrel 1 was pulled out, and then the shaft having the full length of 1168 mm, the small-diameter-end-part outer diameter of 8.5 mm, and the large-diameter-end-part outer diameter of 15.1 to 15.3 mm was obtained by polishing it after cutting 10 mm off the small-diameter end part and cutting 12 mm off the large-diameter end part. However, the mandrel to be used is not limited thereto.

In the mandrel 1, a step-part reinforcing layer 2 (prepreg G) was laminated to have three layers at a position between 120 and 180 mm (up to 60 mm from the front-end of the shaft before cutting). A first hoop layer 3C (prepreg P) and a bias layer 4 (two-layered prepreg U) formed of a carbon fiber formed and pasted at an angle of ±45° were laminated on the outside of the step-part reinforcing layer. A second hoop layer 5C (prepreg P) was wound around the outside of the bias layer, and a first straight layer 6 (two-layered prepreg K), a second straight layer 7 (prepreg L), and a third straight layer 8 (prepreg M) were further sequentially wound around the outside of the second hoop layer. A front-end reinforcing layer 9 was wound around the outside of the third straight layer up to a position 100 mm apart from the front-end, and finally, an outer diameter adjusting layer 10 was wound.

As described above, after heating and hardening the mandrel 1 wound by each fiber-reinforced resin layer, the mandrel 1 was pulled out, and then the shaft having the full length of 1168 mm was obtained by polishing it after cutting 10 mm off the small-diameter side and cutting 12 mm off the large-diameter side. Thereafter, other Comparative Examples and Examples will be described in detail, but a winding position or the like is based on the laminated structure after cutting, unless otherwise specified. For example, the description of "100 mm apart from the front-end of the small-diameter side" represents 100 mm at a state where the shaft is completed, and when being converted into a value before cutting, it becomes "110 mm apart from the front-end of the small-diameter side" in consideration of a cut portion.

In addition, as for the fiber-reinforced resin layer such as the step-part reinforcing layer 2 or the first outer diameter adjusting layer 9 for partially reinforcing, the shape of the end part is cut off in a triangular shape. This is so called "extension portion (relief)", which is used to avoid stress concentration, but the length of the "extension portion (relief)" is 100 mm and is not included in the full length of the reinforcing layer unless otherwise specified. For example, the first outer diameter adjusting layer 9 of this Comparative Example extends 100 mm from the front-end but is laminated to have one layer up to a position of 100 mm, and the extension portion (relief) continuously extends 100 mm from the position. It is considered that the number of laminated layers gradually decreases (for example, a half layers) due to a lamination ratio of the extension portion and a layer is not exactly present (lamination ratio of the extension portion is 0) at a position 200 mm apart from the front-end. The following Examples are the same.

Comparative Example 2

Comparative Example 2 is a case where the straight layers of Comparative Example 1 are modified to the following prepregs, respectively.

First straight layer 6 (prepreg M)

Second straight layer 7 (prepreg N)

Third straight layer 8 (prepreg N)

By the above configuration, a stiff shaft, where the flex in the cantilever bending test is small, that is, the rigidity is high, is prepared. The weight becomes heavy by that much.

Comparative Example 3

Comparative Example 3 is a case where straight layers of Comparative Example 1 are modified to the following prepregs, respectively.

First straight layer 6 (two-layered prepreg M)
Second straight layer 7 (prepreg N)
Third straight layer 8 (prepreg N)

By the above configuration, a stiff shaft, where the flex in the cantilever bending test is small, that is, the rigidity is higher, is prepared. The weight becomes heavy by that much.

Comparative Example 4

In Comparative Example 4, a shaft was prepared in the same manner as in Example 1 to be described below except that one end of a hoop layer was set to be 115 mm and the other end thereof was set to be 935 mm. In Comparative Example 4, the weight was within an error range (significance probability P<0.05; corresponding to a difference in weight of 0.2 g) in relation to the prior art. Further, Wilcoxson signed-rank test was used to verify the difference in the invention.

Comparative Example 5

In Comparative Example 5, a shaft was prepared in the same manner as in Example 2 to be described below except that one end of a hoop layer was set to be 115 mm and the other end thereof was set to be 935 mm. In Comparative Example 5, the weight was within an error range (significance probability P<0.05; corresponding to a difference in weight of 0.2 g) in relation to the prior art.

Comparative Example 6

In Comparative Example 6, a shaft was prepared in the same manner as in Example 3 to be described below except that one end of a hoop layer was set to be 115 mm and the other end thereof was set to be 935 mm. In Comparative Example 6, the weight was within an error range (significance probability P<0.05; corresponding to a difference in weight of 0.2 g) in relation to the prior art.

Comparative Example 7

In Comparative Example 7, a shaft was prepared in the same manner as in Example 2 to be described below except that one end of a hoop layer was set to be 400 mm and the other end thereof was set to be 925 mm. In Comparative Example 7, the strength at T-525 became insufficient.

Comparative Example 8

In Comparative Example 8, a shaft was prepared in the same manner as in Example 2 to be described below except that one end of a hoop layer was set to be 125 mm and the other end thereof was set to be 650 mm. In Comparative Example 8, the strength at T-525 became insufficient.

Example 1

FIG. 8 is a schematic diagram illustrating a laminated structure in Example 1 of the invention. In Example 1, a shaft was prepared in the same manner as in Comparative Example 1 except that hoop layers were respectively modified as follows.

In a first hoop layer 3A (prepreg O), a position 675 mm apart from an end part of a small-diameter side becomes a winding end position.

In a second hoop layer 5A (prepreg P), a position 375 mm apart from the end part of the small-diameter side becomes a winding start position.

Example 2

In Example 2, a shaft was prepared in the same manner as in Comparative Example 2 except that hoop layers were respectively modified as follows.

In a first hoop layer 3A (prepreg P), a position 675 mm apart from an end part of a small-diameter side becomes a winding end position.

In a second hoop layer 5A (prepreg P), a position 375 mm apart from the end part of the small-diameter side becomes a winding start position.

Example 3

In Example 3, a shaft was prepared in the same manner as in Comparative Example 3 except that hoop layers were respectively modified as follows.

In a first hoop layer 3A (prepreg P), a position 675 mm apart from an end part of a small-diameter side becomes a winding end position.

In a second hoop layer 5A (prepreg P), a position 375 mm apart from the end part of the small-diameter side becomes a winding start position.

In Examples 1 to 3, a bias layer 4 was configured to have exactly two layers over a full length as in Comparative Examples 1 to 3. Since the bias layer 4 is originally configured such that two sheets are attached to each other, the bias layer is provided to have substantially four layers. By forming in this way, it is possible to stably obtain the strength even when the strength is measured at any position in a circumferential direction.

Example 4

In Example 4, a shaft was prepared in the same manner as in Example 1 except that one end of a hoop layer was set to be 125 mm, the other end thereof was set to be 925 mm, and an angle layer was provided to have 1.9 layers. In Example 4, the weight value was out of an error range (significance probability P<0.05; corresponding to a difference in weight of 0.2 g) in relation to the prior art.

Example 5

In Example 5, a shaft was prepared in the same manner as in Example 2 except that one end of a hoop layer was set to be 125 mm, the other end thereof was set to be 925 mm, and an angle layer was provided to have 1.9 layers. In Example 5, the weight value was out of an error range (significance probability P<0.05; corresponding to a difference in weight of 0.2 g) in relation to the prior art.

Example 6

In Example 6, a shaft was prepared in the same manner as in Example 3 except that one end of a hoop layer was set to be 125 mm, the other end thereof was set to be 925 mm, and an angle layer was provided to have 1.9 layers. In Example 6, the weight value was out of an error range (significance probability P<0.05; corresponding to a difference in weight of 0.2 g) in relation to the prior art.

Example 7

In Example 7, a shaft was prepared in the same manner as in Example 1 except that bias layer 4 was increased from two layers to 2.2 layers.

Example 8

In Example 8, a shaft was prepared in the same manner as in Example 2 except that bias layer 4 was increased from two layers to 2.3 layers.

Example 9

In Example 9, a shaft was prepared in the same manner as in Example 3 except that bias layer 4 was increased from two layers to 2.4 layers.

Example 10

FIG. 10 is a schematic diagram illustrating Example 10. Example 10 is a case where the following two layers are added to the structure of Example 1.

Front-end straight reinforcing layer 11 (prepreg A): winding is ended at a position of 375 mm.

Rear-end straight reinforcing layer 12 (prepreg A): winding starts at a position of 675 mm.

In this Example, it was formed such that a winding end position of the front-end straight reinforcing layer 11 and a winding start position of a second hoop layer B coincided with each other or the winding end position of the front-end straight reinforcing layer 11 was located at a large-diameter end part side compared to the winding start position of the second hoop layer B and that a winding start position of the rear-end straight reinforcing layer 12 and a winding end position of a first hoop layer A coincided with each other or the winding end position of the first hoop layer A was located at the large-diameter end part side compared to the winding start position of the rear-end straight reinforcing layer 12. A "winding start" indicates a point at which one layer starts and is entirely defined by the small-diameter side. A "winding end" indicates a point at which one layer is ended and is entirely defined by the large-diameter side.

The front-end straight reinforcing layer 11 affects a height of a trajectory or a bounce in a horizontal direction, and the rear-end straight reinforcing layer 12 affects swing feeling of the club. That is, in order to satisfy performance required by a golfer while being lightweight, it is possible to use by approximately selecting these two layers. Further, in the case of using the two layers, using degree can be designed.

In general, when such partial reinforcing layers are put, the strength of end parts thereof is reduced due to the stress concentration. In this Example, the end part of the partial reinforcing layer and the end part of the hoop layer were overlapped with each other when viewed from the cross-sectional direction to prevent the reduction of the strength.

These end parts may not be overlapped with each other, and even if there is a gap, sufficient strength is satisfied as long as the first hoop layer 3A and the second hoop layer 5A have an overlapped portion. When the length of the overlapped portion is too long, the weight is increased. Therefore, the overlapped portion is preferably 100 mm or shorter. In addition, as described above, when the first hoop layer 3A and the second hoop layer 5A are overlapped with each other in the range of 525±150 mm, the reference strength standard is satisfied. The front-end straight reinforcing layer 11 and the second hoop layer 5A may be overlapped with each other, and the first hoop layer 3A and the rear-end straight reinforcing layer 12 may be overlapped with each other. However, in order to achieve both of the light weight and the strength at a high level, it is most preferred that the end parts are overlapped (matched) with each other when viewed from the cross-sectional direction.

Examples 11 to 16

Figure 11:
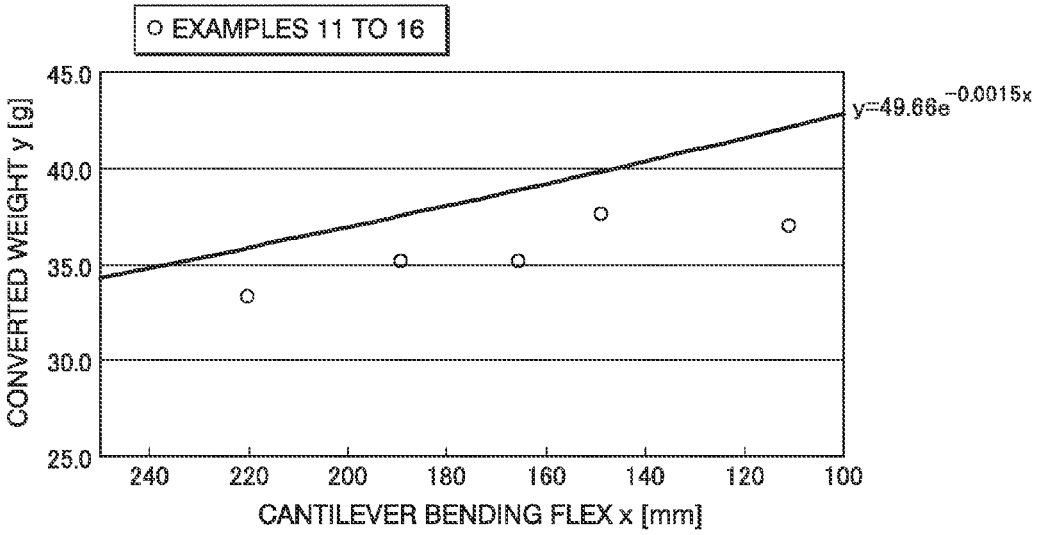
FIG. 11 is a diagram illustrated by plotting relationship of results obtained from Examples 7 to 13.

In Examples 11 to 16, shafts having a full length of 1092 mm or 1194 mm are prepared, stiffness and weight are slightly changed as indicated in Table 4, and the weight thereof is converted in terms of weight of the shaft having the length of 1168 mm. As illustrated in FIG. 11, it was confirmed that values fallen within a range of a mathematical formula even in different kinds of length, stiffness, and weight.

Example 17

In Example 17, a shaft was prepared in such a manner as in Example 1 except that bias layer 4 was provided to have 1.3 layers.

Example 18

In Example 18, a shaft was prepared in such a manner as in Example 2 except that bias layer 4 was provided to have 1.3 layers.

Example 19

In Example 19, a shaft was prepared in such a manner as in Example 3 except that bias layer 4 was provided to have 1.3 layers.

Example 20

In Example 20, a shaft was prepared in such a manner as in Example 1 except that bias layer 4 was provided to have 1.6 layers.

Example 21

In Example 21, a shaft was prepared in such a manner as in Example 2 except that bias layer 4 was provided to have 1.6 layers.

Example 22

In Example 22, a shaft was prepared in such a manner as in Example 3 except that bias layer 4 was provided to have 1.6 layers.

Table 3 indicates a list of evaluation results of Comparative Examples, and Table 4 indicates a list of evaluation results of Examples. The result is an average value of n=6.

TABLE 3

| | Character | Overwrap Area mm | Length mm | Weight gr | Flex Board mm | Torque deg | T-90 N | T-175 N | T-525 N | B-175 N |
|---|---|---|---|---|---|---|---|---|---|---|
| Comparative Example 1 | Low rigidity Conventional shaft | 0-1168 | 1168 | 36.2 | 215 | 6.7 | 809 | 446 | 402 | 434 |
| Comparative Example 2 | Middle rigidity Conventional shaft | 0-1168 | 1168 | 39.0 | 160 | 6.4 | 892 | 510 | 421 | 470 |
| Comparative Example 3 | High rigidity Conventional shaft | 0-1168 | 1168 | 41.4 | 125 | 6.1 | 858 | 598 | 412 | 461 |
| Comparative Example 4 | Low rigidity 115-935 Shaft | 115-935 | 1168 | 36.3 | 215 | 6.7 | 823 | 451 | 441 | 529 |
| Comparative Example 5 | Middle rigidity 115-935 Shaft | 115-935 | 1168 | 39.0 | 160 | 6.4 | 882 | 519 | 441 | 470 |

TABLE 3-continued

| | Character | Overwrap Area mm | Length mm | Weight gr | Flex Board mm | Torque deg | T-90 N | T-175 N | T-525 N | B-175 N |
|---|---|---|---|---|---|---|---|---|---|---|
| Comparative Example 6 | High rigidity 115-935 Shaft | 115-935 | 1168 | 41.5 | 125 | 6.1 | 902 | 578 | 470 | 490 |
| Comparative Example 7 | Middle rigidity 400-925 Shaft | 400-925 | 1168 | 39.5 | 160 | 6.4 | 862 | 402 | 372 | 519 |
| Comparative Example 8 | Middle rigidity 125-650 Shaft | 125-650 | 1168 | 39.4 | 160 | 6.4 | 843 | 470 | 363 | 470 |

TABLE 4

| | Character | Overwrap Area mm | Length mm | Weight (Converted Weight) gr | Flex Board mm | Torque deg | T-90 N | T-175 N | T-525 N | B-175 N |
|---|---|---|---|---|---|---|---|---|---|---|
| Example 1 | Low rigidity 375-675 Shaft | 375-675 | 1168 | 35.9 | 215 | 6.7 | 864 | 480 | 439 | 447 |
| Example 2 | Middle rigidity 375-675 Shaft | 375-675 | 1168 | 38.7 | 160 | 6.4 | 860 | 459 | 446 | 462 |
| Example 3 | High rigidity 375-675 Shaft | 375-675 | 1168 | 41.1 | 125 | 6.1 | 893 | 494 | 478 | 441 |
| Example 4 | Low rigidity 125-925 Shaft | 125-925 | 1168 | 35.6 | 215 | 6.7 | 862 | 470 | 451 | 470 |
| Example 5 | Middle rigidity 125-925 Shaft | 125-925 | 1168 | 38.4 | 160 | 6.4 | 872 | 480 | 470 | 578 |
| Example 6 | High rigidity 125-925 Shaft | 125-925 | 1168 | 40.8 | 125 | 6.1 | 804 | 510 | 480 | 539 |
| Example 7 | Low rigidity 250-800 Shaft | 250-800 | 1168 | 35.3 | 215 | 6.5 | 911 | 500 | 480 | 500 |
| Example 8 | Middle rigidity 250-800 Shaft | 250-800 | 1168 | 38.0 | 160 | 6.2 | 1078 | 568 | 588 | 578 |
| Example 9 | High rigidity 250-800 Shaft | 250-800 | 1168 | 39.7 | 125 | 5.9 | 1274 | 666 | 725 | 666 |
| Example 10 | Shaft having front-end straight reinforcing layer and rear-end straight reinforcing layer | 250-800 | 1168 | 36.8 | 200 | 6.6 | 823 | 461 | 441 | 461 |
| Example 11 | Short | 250-800 | 1092 | 34.8 (37.2) | 180 | 6.5 | 823 | 431 | 421 | 480 |
| Example 12 | Short | 250-800 | 1092 | 42.4 (45.3) | 115 | 6.0 | 833 | 480 | 490 | 529 |
| Example 13 | Short | 250-800 | 1092 | 38.3 (41.0) | 140 | 6.3 | 794 | 500 | 470 | 529 |
| Example 14 | Long | 250-800 | 1194 | 39.4 (38.5) | 170 | 6.5 | 872 | 431 | 470 | 412 |
| Example 15 | Long | 250-800 | 1194 | 42.3 (41.4) | 150 | 6.2 | 1098 | 588 | 598 | 568 |
| Example 16 | Long | 250-800 | 1194 | 46.5 (45.5) | 105 | 5.7 | 1323 | 676 | 706 | 676 |
| Example 17 | Low rigidity Lightest weight shaft | 375-675 | 1168 | 28.0 | 215 | 8.7 | 805 | 407 | 402 | 403 |
| Example 18 | Middle rigidity Lightest weight shaft | 375-675 | 1168 | 29.2 | 160 | 8.5 | 812 | 410 | 411 | 407 |
| Example 19 | High rigidity Lightest weight shaft | 375-675 | 1168 | 31.3 | 125 | 8.1 | 807 | 409 | 403 | 401 |
| Example 20 | Low rigidity Stably prepared lightest weight shaft | 375-675 | 1168 | 34.5 | 215 | 7.7 | 833 | 438 | 432 | 451 |
| Example 21 | Middle rigidity Stably prepared lightest weight shaft | 375-675 | 1168 | 36.4 | 160 | 7.4 | 831 | 428 | 455 | 432 |
| Example 22 | High rigidity Stably prepared lightest weight shaft | 375-675 | 1168 | 37.6 | 125 | 7.0 | 842 | 481 | 428 | 444 |

In Comparative Examples 1 to 3, the shafts having the light weight as possible are prepared using the prior art and satisfy the reference strength standard. As described above, since the strength at T-525 was lowest n the prior art, the shaft was designed such that the strength at T-525 was 400 N or more. The shaft is classified into three types of low rigidity, middle rigidity, and high rigidity, and these kinds of rigidity are values obtained by the cantilever bending test as described above.

Values of 215 mm, 160 mm, and 125 mm are sequentially listed from the low rigidity, and these values correspond to R-, S-, and X-flex of a commercially marketed shaft, respectively. As described above, since the shaft becomes more brittle as it becomes stiffer, the shaft is required to be heavy in order to have equivalent strength.

In Comparative Examples 4 to 8, the shafts are prepared beyond the range of the invention.

In Examples 1 to 3, the shafts having the light weight as possible and satisfy the reference strength standard are prepared using the invention. Thus, when using the invention, since substantially equivalent strength can be obtained at T-175, T-525, and B-175, it was possible to achieve as much weight lightening as the surplus weight distributed at T-175 and B-175 was removed.

In Examples 4 to 6, the shafts are formed using the invention so as to obtain the significant difference of the weight exceeding the error range compared to the prior art. In Examples 7 to 9, the high strength shafts having the light weight as possible are prepared using the invention. Since the high strength shaft is used for persons having a high club head speed, it is very useful. In Examples 4 to 9, when using the invention, it was possible to obtain the shafts which satisfied the reference strength standard and was lightweight more compared to Examples 1 to 3.

In Examples 17 to 19, the lightest weight shafts are prepared using the invention. Further, in Examples 20 to 22, the stably lightest weight shafts are prepared using the invention. In Examples 17 to 22, the lightest weight shafts were prepared using the invention.

INDUSTRIAL APPLICABILITY

According to the golf club shaft of the invention, it is possible to further lighten the weight by obtaining a uniform strength distribution, and thus it is extremely useful in industrial utilization.

EXPLANATIONS OF LETTERS OR NUMERALS

1: mandrel
2: step-part reinforcing layer
3, 3A, 3B, 3C: first hoop layer
4: bias layer
5, 5A, 5B, 5C: second hoop layer
6: first straight layer
7: second straight layer
8: third straight layer
9: front-end reinforcing layer
10: outer diameter adjusting layer
11: front-end straight reinforcing layer
12: rear-end straight reinforcing layer

The invention claimed is:

1. A golf club shaft formed of one or more fiber-reinforced resin layers, the golf club shaft comprising:

a bias layer that is formed by overlapping fiber-reinforced resin layers, in which orientation directions of reinforcing fibers are +35° to +55° and −35° to −55° relative to a longitudinal direction of the shaft, with each other;

a straight layer that is formed of a fiber-reinforced resin layer in which an orientation direction of the reinforcing fiber is −5° to +5° relative to the longitudinal direction of the shaft; and a hoop layer that is formed of a fiber-reinforced resin layer in which an orientation directions of the reinforcing fiber is +85° to +95° relative to the longitudinal direction of the shaft, wherein the hoop layer is formed of two fiber-reinforced resin layers of a first hoop layer and a second hoop layer, the two hoop layers have an overlapped portion, one end of the overlapped portion is located between 125 mm and 375 mm apart from the small-diameter end part of the shaft, and the other end of the overlapped portion is located between 675 mm and 925 mm from the small-diameter end part of the shaft.

2. The golf club shaft according to claim 1, wherein one end of the first hoop layer is located at the small-diameter end part of the shaft and the other end thereof is located between 675 mm and 925 mm from the small-diameter end part of the shaft, and one end of the second hoop layer is located between 125 mm and 375 mm from the small-diameter end part of the shaft and the other end thereof is located at the large-diameter end part of the shaft.

3. The golf club shaft according to claim 1, wherein the first hoop layer has a thickness thinner than that of the second hoop layer, and at least one of the straight layer and the bias layer is laminated between the first hoop layer and the second hoop layer.

* * * * *